US005853499A

United States Patent [19]

Komatsubara et al.

[11] Patent Number: 5,853,499

[45] Date of Patent: Dec. 29, 1998

[54] GRAIN-ORIENTED ELECTRICAL STEEL SHEET AND METHOD OF MANUFACTURING THE SAME

[75] Inventors: Michiro Komatsubara; Kunihiro Senda; Takafumi Suzuki; Hiroaki Toda; Hiroi Yamaguchi, all of Okayama, Japan

[73] Assignee: Kawasaki Steel Corporation, Japan

[21] Appl. No.: 919,758

[22] Filed: Aug. 28, 1997

Related U.S. Application Data

[62] Division of Ser. No. 756,213, Nov. 25, 1996, Pat. No. 5,718,775.

[30] Foreign Application Priority Data

Nov. 27, 1995 [JP] Japan ..... 7-307794

[51] Int. Cl.[6] ..... H01F 1/147

[52] U.S. Cl. ..... 148/113; 148/111

[58] Field of Search ..... 148/110, 111, 148/112, 113

[56] References Cited

FOREIGN PATENT DOCUMENTS

| | | |
|---|---|---|
| 0 047 129 A1 | 3/1985 | European Pat. Off. . |
| 0 488 726 A2 | 6/1992 | European Pat. Off. . |
| 0 565 029 A1 | 10/1993 | European Pat. Off. . |
| 0 588 342 A1 | 3/1994 | European Pat. Off. . |
| 07 188775 A | 7/1995 | Japan . |

*Primary Examiner*—John Sheehan
*Attorney, Agent, or Firm*—Austin R. Miller

[57] ABSTRACT

Grain-oriented electrical steel sheet having a very low iron loss with controlled area ratio of fine grains, average grain size of coarse grains, obliquity of the grain boundary line of coarse grains, permeability under 1.0 T, and film tension.

4 Claims, 7 Drawing Sheets

GRAIN-ORIENTED ELECTRICAL STEEL SHEET AND METHOD OF MANUFACTURING THE SAME

This application is a divisional of application Ser. No. 08/756,213, filed Nov. 25, 1996 now U.S. Pat. No. 5,718,775.

BACKGROUND OF THE INVENTION

1. Field of the Invention

The present invention relates to a grain-oriented electrical steel sheet for an iron core of a transformer or a power generator, and particularly, to a grain-oriented steel sheet having excellent magnetic properties, together with a method of manufacturing the same.

2. Description of the Related Art

Grain-oriented electrical steel sheets are used for stacked cores or wound cores of large-sized transformers. For this purpose, such a grain-oriented electrical steel sheet is required to undergo only a small energy loss (iron loss) resulting from energy inefficiency.

One of the techniques to reduce iron loss is to align the [001] axis which is an easy magnetization axis of iron crystals with the rolling direction of a steel sheet. It is therefore believed necessary to highly align crystal grains composing the steel sheet (hereinafter referred to as "secondary recrystallized grains") in the (110)[001] orientation (hereinafter referred to as the "Goss orientation") of the grains.

For this alignment to Goss orientation, secondary recrystallization is effectively utilized. More specifically, occurrence of abnormal grain growth having a very strong orientation selectivity in the course of thermal growth of normal crystal grains (hereinafter referred to as "primary recrystallized grains"), is utilized. In this utilization, it is essential to control two factors including orientation selectivity and growth rate of abnormal grains, with a view to obtaining secondary recrystallized grains having a high alignment in Goss orientation.

For this purpose, for the primary recrystallization structure before secondary recrystallization, it is important to achieve a prescribed texture and to keep an appropriate balance of the grain size of grains other than those in Goss orientation, and to keep applying the inhibiting force of the inhibitor for inhibiting grain growth (the force inhibiting grain boundary migration caused by precipitates in steel, which is a second phase of dispersion, or by segregation of segregating elements on grain boundaries).

For the latter purpose, it is known that AlN has a strong inhibiting effect and is most suitable. A method of manufacturing grain-oriented electrical steel sheet containing AlN as an inhibitor component is disclosed in Japanese Examined Patent Publication No. 46-23820.

According to the method disclosed in Japanese Examined Patent Publication No. 46-23820, however, although secondary recrystallized grains, alignment in Goss orientation was achieved, this iron loss of the product was not always reduced. This is attributable to inevitable coarsening of secondary recrystallized grains. To solve this problem, resort was had to a technique to reduce iron loss by decreasing the average grain size of the secondary recrystallized grains, as discussed in Japanese Examined Patent Publication No. 59-20745. The concept of reducing iron loss by controlling the number and distribution of fine secondary recrystallized grains, was disclosed in Japanese Examined Patent Publication No. 4-19296.

In these techniques using extra-fine or fine grains, however, which are incompatible with the technical idea of a grain-oriented electrical steel sheet containing Al, defective secondary recrystallization is often caused in the products, resulting in serious deterioration of magnetic properties.

SUMMARY OF THE INVENTION

The present invention has, as an object, to provide a favorable crystal structure in an electrical steel sheet and a manufacturing method thereof, based upon quite a novel finding regarding the effect of the size of secondary recrystallized grains, grain boundaries thereof, surface film of the steel sheet and magnetic permeability exerted in a composite manner on iron loss.

The present invention achieves the foregoing objects by providing:

(1) A grain-oriented electrical steel sheet having a very low iron loss, which contains from about 1.5 to 5.0 wt. % Si, and which comprises a combination of the following features:

the crystal grains of the steel sheet have an area ratio of up to 15% of fine crystal grains of a size less than about 3 mm (as a diameter of an equivalent circle) to the total area of the steel sheet;

that the remaining crystal grains other than the fine crystal grains have an average grain size within a range of from about 10 mm to 100 mm;

that the obliquity calculated from an angle between a grain boundary straight line approximating crystal grain boundaries of the remaining crystal grains with a straight line, on the one hand, and the rolling direction of the steel sheet or an angle perpendicular to the rolling direction, on the other hand, is up to about 30°;

that the steel sheet has a magnetic permeability of at least about 0.03 H/m under 1.0 T; and that the steel sheet has a tension film which imparts to the steel sheet a tension within a range of from about 0.4 to 2.0 kgf/mm$^2$ per surface of the steel sheet. Preferably the obliquity is up to 25°.

Grooves are preferably provided having a maximum depth of at least about 12 $\mu$m and a width within a range of from about 50 to 500 $\mu$m at intervals within a range of from about 3 to 20 mm on the surface of the steel sheet.

A region containing fine strain in a surface layer of the steel sheet is formed irk the rolling direction at a period within a range of from about 3 to 20 mm.

A method is provided for manufacturing a grain-oriented electrical steel sheet having a very low iron loss, comprising the steps of hot-rolling a grain-oriented electrical steel slab containing from about 0.01 to 0.10 wt. % C, from about 1.5 to 5.0 wt. % Si, from about 0.04 to 2.0 wt. % Mn, and from about 0.005 to 0.050 wt. % Al, achieving a final sheet thickness through a single stage or a plurality of stages, with intermediate annealing in between any such plural stage, of cold rolling, and then subjecting the steel sheet to decarburizing annealing and then to final annealing.

Annealing is carried out immediately before final cold rolling to form a desiliconization layer through the annealing step; and From from about two to ten passes of final cold or warm rolling are conducted, and at least about two of which are carried out as warm rolling at a temperature within a range of from about 150° to 300° C.

After the decarburizing annealing, the surface of the steel sheet has an oxide composition having a peak ratio of fayalite (Af) to silica (As) in infrared reflection spectrum, Af/As, of at least about 0.8.

Metal oxides that are capable of slowly releasing oxygen at least at a temperature within a range of from about 800° to 1,050° C. are added in a total amount within a range of from about 1.0 to 20% to an annealing separator applied before final annealing.

Final annealing is carried out at a heating rate of at least about 5° C./hr. from about 870° C. to at least about 1,050° C.

A tension coating is formed on the steel sheet after final annealing, wherein, in the stage after final cold rolling and before decarburizing annealing, grooves having a maximum depth of at least about 12 μm are provided in the rolling direction at intervals within a range of from about 3 to 20 mm on the surface of the steel sheet and wherein, after final finish annealing, grooves having a maximum depth of at least about 12 μm are provided in the rolling direction at intervals within a range of from about 3 to 20 mm on the surface of the steel sheet. Alternately regions containing fine strain in the surface layer of the steel sheet at a period within a range of from about 3 to 20 mm are formed in the rolling direction.

DESCRIPTION OF THE PREFERRED EMBODIMENTS

We have carried out numerous studies of techniques for reducing iron loss without depending upon creation and maintenance of fine crystal grains in a steel sheet. As a result, it has been discovered that iron loss may sometimes be very largely reduced when crystal grains become coarser than a certain size but are controlled as to straightness and angularity or obliguity. Our findings also indicate that a high area ratio of fine crystal grains is detrimental, and that reducing the area ratio to below an important value of 15% is effective for reducing iron loss. It has now been discovered that these detrimental fine crystal grains are ones having a size of up to about 3 mm expressed as the diameter of an equivalent circle that has the same area as the actual shaped grain.

Figure 1:
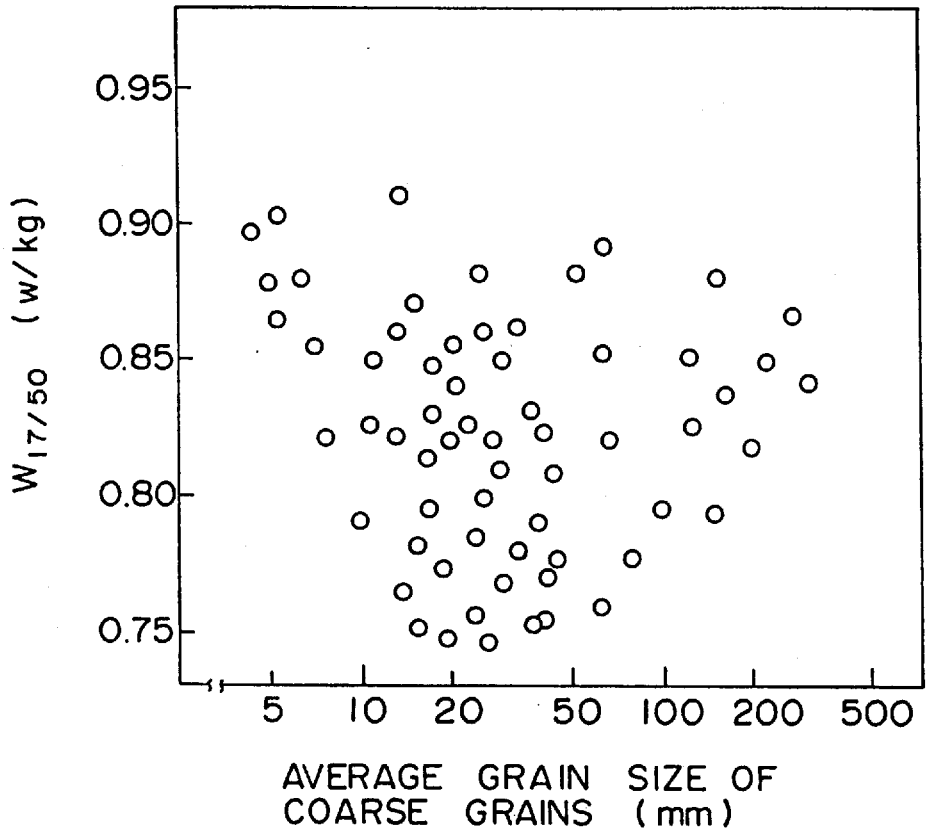
FIG. 1 is a graph illustrating the relationship between the average grain size of coarse crystal grains and iron loss.
Figure 2:
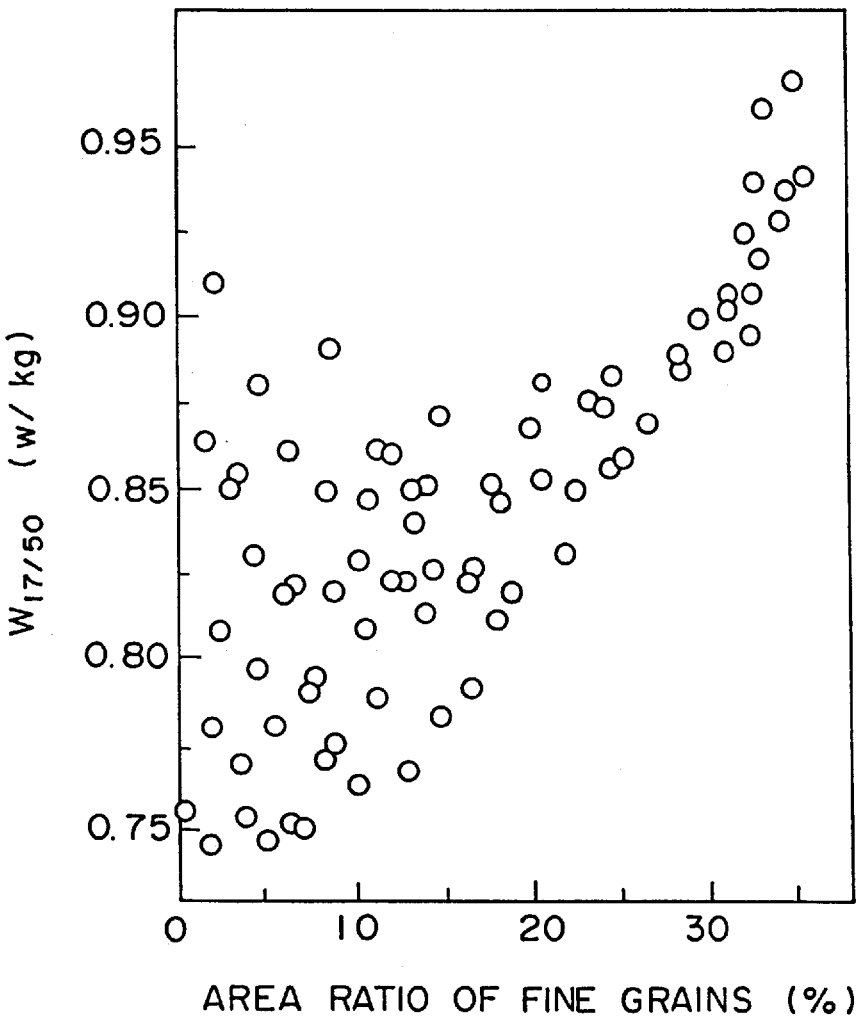
FIG. 2 is a graph illustrating the relationship between the area ratio of fine crystal grains and iron loss.

FIG. 1 is a graph illustrating results of our investigations of the relationship, for a sample grain-oriented electrical steel sheet containing 3% Si and having a thickness of 0.23 mm, in which the area ratio of fine crystal grains is from infinitesimal up to about 15%, between the iron loss value and the average grain size (as a diameter of the aforesaid equivalent circle) of coarse grains other than detrimental fine grains. FIG. 2 is a graph illustrating the results of investigation, for a grain-oriented electrical steel sheet, in which coarse crystal grains had an average grain size within a range of from about 15 to 50 mm of the relationship between the area ratio of fine grains and the iron loss.

When fine grains have a small area ratio, as shown in FIG. 1, the grain-oriented electrical steel sheet sometimes has such a very low iron loss, as represented by a $W_{17/50}$ value of up to about 0.85 W/kg with an average grain size of coarse grains within a range of from about 10 to 100 mm. When coarse grains have a large size, such as those shown in FIG. 2, a grain-oriented electrical steel sheet of a very low iron loss may be achieved if the area ratio of the fine grains is lower. To obtain a grain-oriented electromagnetic steel sheet having such a very low iron loss, the fine grains should have an area ratio of up to about 15% but not substantially above.

Presence of these fine grains is detrimental because the crystal orientation shifts from (110)[001] and this prevents smooth flow of magnetic flux in the rolling direction of the steel sheet, resulting in a non-uniform distribution of flux density.

However, even if crystal grains of the steel sheet are limited to be within the foregoing range of suitable grain size, values of iron loss are largely dispersed as shown in FIGS. 1 and 2, and this does not ensure that the grain-oriented electrical steel sheet will have a low iron loss.

The present inventors carried out extensive studies on reasons underlying such a broad dispersion of iron loss values. Novel findings have been made that the angle of the grain boundary delimiting adjacent grains with the rolling direction (or perpendicular to the rolling direction) (hereinafter referred to as the angle of "obliquity") had a very important effect on iron loss.

Figure 3A:
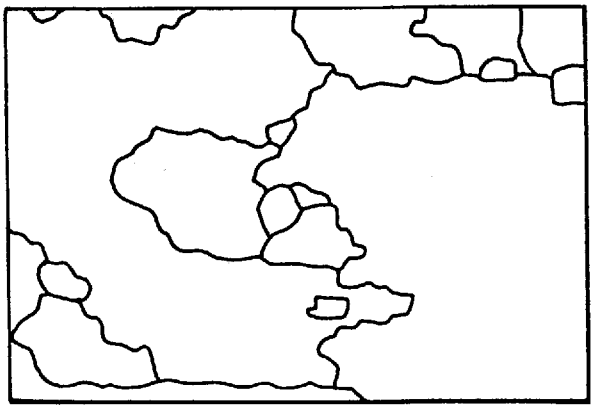
FIGS. 3A and 3B illustrate the relationship between grain boundary structure and magnetic domain structure.
Figure 3B:
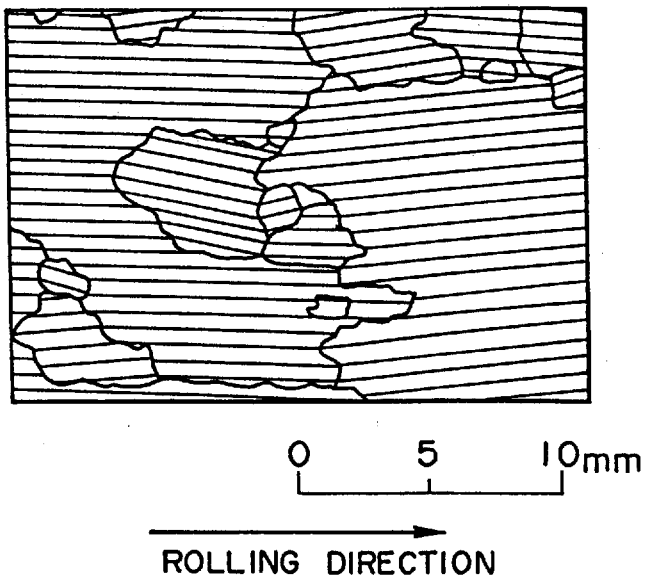

Such an angle of obliquity of a grain boundary of larger grains is dependent largely upon the appropriate angle of the grain boundary, not upon the fineness of the structure of the grain boundary, and not upon the presence of fine crystal grains. FIG. 3B illustrates a typical magnetic domain structure of a 3% grain-oriented electrical steel sheet, and FIG. 3A shows the grain boundaries thereof. This indicates that the curved portion of the grain boundary, and presence of fine irregularities of the grain boundaries, and the presence of fine grains within the grains, have no effect on the magnetic domain structure of the coarse grains.

We have discovered that it is very effective for reducing iron loss to represent the grain boundary with an approximately straight line, to define the "obliquity" angle as having a value showing the tendency of this obliquity relative to the entire steel sheet, and to control this obliquity.

Figure 4A:
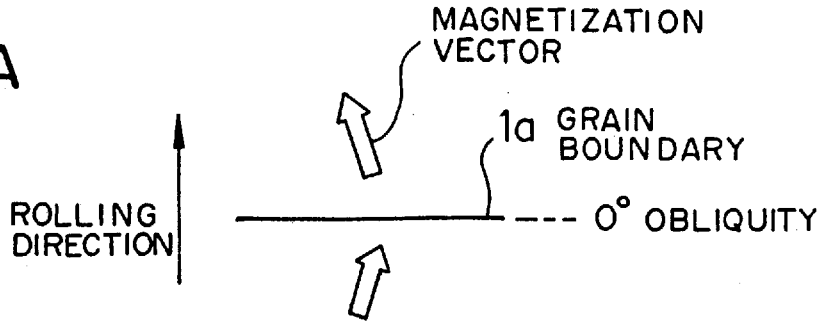
FIGS. 4A, 4B and 4C are sketches illustrating the relationship between grain boundary straight line (thick lines), spontaneous magnetization direction (thick arrows) and affected zone (hatched portions on the metal surface of generation of magnetic poles.
Figure 4B:
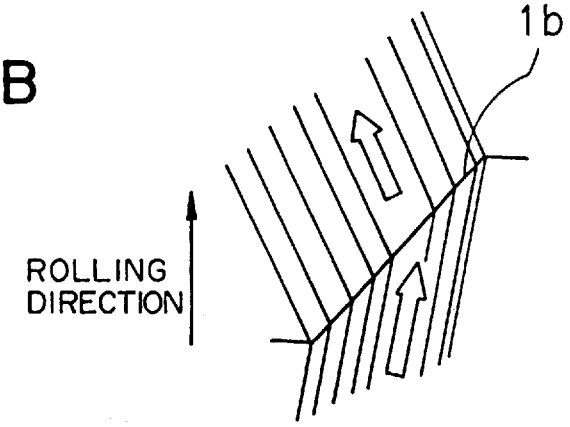
Figure 4C:
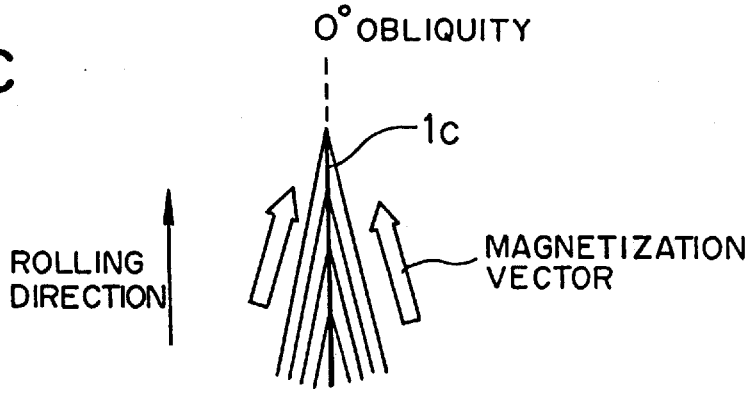

FIGS. 4A to 4C illustrate the directions of grain boundary 1*a*, 1*b*, 1*c* relative to the rolling direction of the steel sheet, and the magnetization vectors (thick arrows) within each crystal grain. A magnetization vector has , as shown, both a "plus" and a "minus" direction corresponding to two 180° magnetic domains. In the drawing, only one direction is indicated as a representative rolling direction. The direction of the magnetization vector agrees with the <001> axis of the crystal, and the <001> axes of crystal orientation of the grain-oriented electrical steel sheet are substantially symmetrically distributed at a slight angle around the rolling direction. The magnetization vectors are therefore represented in the form as shown in FIGS. 4A, 4B and 4C.

When a grain boundary 1*a* (FIG. 4A) is perpendicular to the rolling direction (obliquity=0°), as shown in FIG. 4A, components perpendicular to the grain boundary directions of magnetization vectors falling under two grains have the same directions and sizes. There is therefore no magnetic pole produced in the grain boundary 1*a* of FIG. 4A.

When the grain boundary 1*c* (FIG. 4C) extends in the rolling direction (oblique angle=0°), as shown in FIG. 4C, the components at angles perpendicular to the grain boundary direction of magnetization vectors falling under two grains, having the grain boundary in between, have the same sizes. However, because they are contrary in direction, a high-density magnetic pole is produced in the grain boundary. But the only magnetic domain affected by the magnetic pole is the hatched portion in FIG. 4C, which is a very narrow region, resulting in a rather uniform distribution for most of the flux density.

When the direction of grain boundary 1*b* (FIG. 4B) makes an angle of 45° to the rolling direction, as shown in FIG. 4B, in contrast, a magnetic pole of a substantial density is produced in the grain boundary. The magnetic domain affected by this magnetic pole covers a wide area such as the hatched portion in FIG. 4B. As a result, the area of decreased magnetic density increases, bringing about non-uniformity of distribution, which causes serious deterioration of iron loss. Therefore, it has been found effective for improving iron loss to reduce the presence of crystal grain boundaries having such a large oblique angle as 45° as shown in FIG. 4B.

Basically, obliquity can be determined, in a surface of a steel sheet after etching for macro-structure, by applying image processing of a region containing ten or more remaining crystal grains, excluding crystal grains having a diameter of zero up to about 3 mm, the diameter being expressed as a diameter of an equivalent circle (a circle having the same area as the grain).

(1) We have found that fine crystal grains such as those having a diameter of zero up to 3 mm (expressed as a diameter of an equivalent circle) have almost no effect on iron loss, but only if the area ratio is kept in the range of zero to about 15%. These grains are therefore caused to "disappear". In this case, the position of the center of gravity of fine crystal grains must serve as the central point of the disappearing direction.

(2) In performing the analysis, triple points are located where three coarse crystal grains are in contact on their grain boundaries, and adjacent triple points are connected by straight lines. Each connecting line is hereinafter referred to as a "grain boundary line." On the boundary between a measurement region and a non-measurement region, the point of intersection of a grain boundary and a measurement region is selected as a triple point.

(3) Then, the oblique angle $\theta_i$ of this grain boundary line i (the smaller of two angles between the rolling direction and the grain boundary line and an angle perpendicular to the rolling direction and the grain boundary line is defined as the oblique angle) is measured, and a value is obtained by arithmetically averaging $\theta_i$ with the length $l_i$ of its grain boundary line, i.e., $$<\theta> = \frac{\Sigma\theta_i l_i}{\Sigma l_i}$$

This is defined as the angle of obliquity <θ>.

As compared with the foregoing grain boundary line, actual grain boundaries are curved and much more complicated. The complicated structures of grain boundaries have, however, almost no effect on uniformity of the magnetic flux density, as described previously, and only the overall orientation of grain boundary affects the flux density distribution The grain boundary line thus constructed is therefore superior to actual grain boundaries as an indicator.

Figure 5:
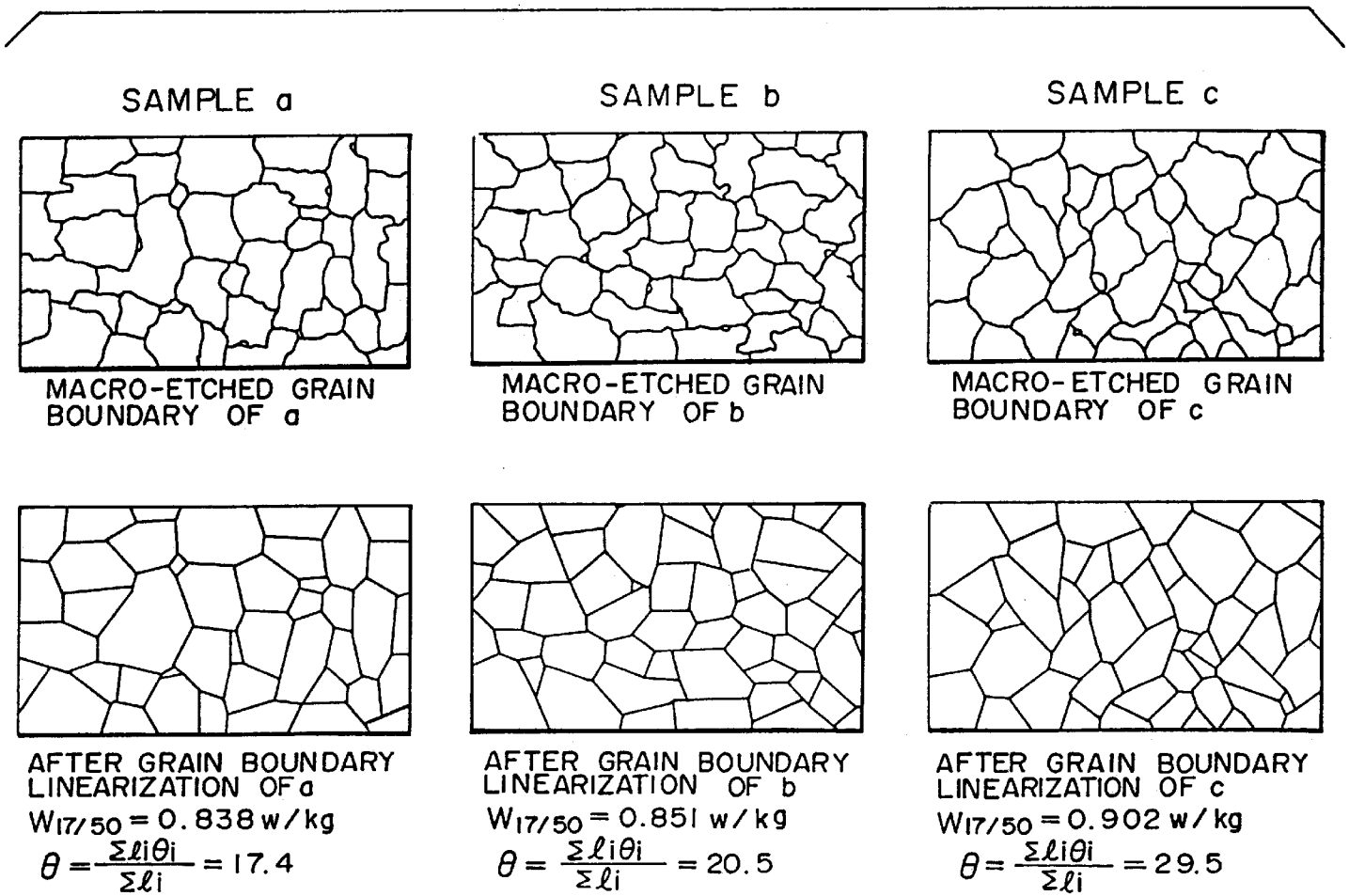
FIG. 5 illustrates three sets of comparative representations of examples of three cases a, b and c where a grain boundary linearization of coarse crystal grains is conducted from a macro-etched grain boundary, and where determinations of obliquity are made from each.

By the use of this technique, a grain boundary linearization of coarse grains was applied for macro-etched grain boundaries to determine obliquity. The result is illustrated in FIG. 5. The result shown in FIG. 5 is that iron loss is low in samples a and b of FIG. 5 having smaller obliquity.

Figure 6:
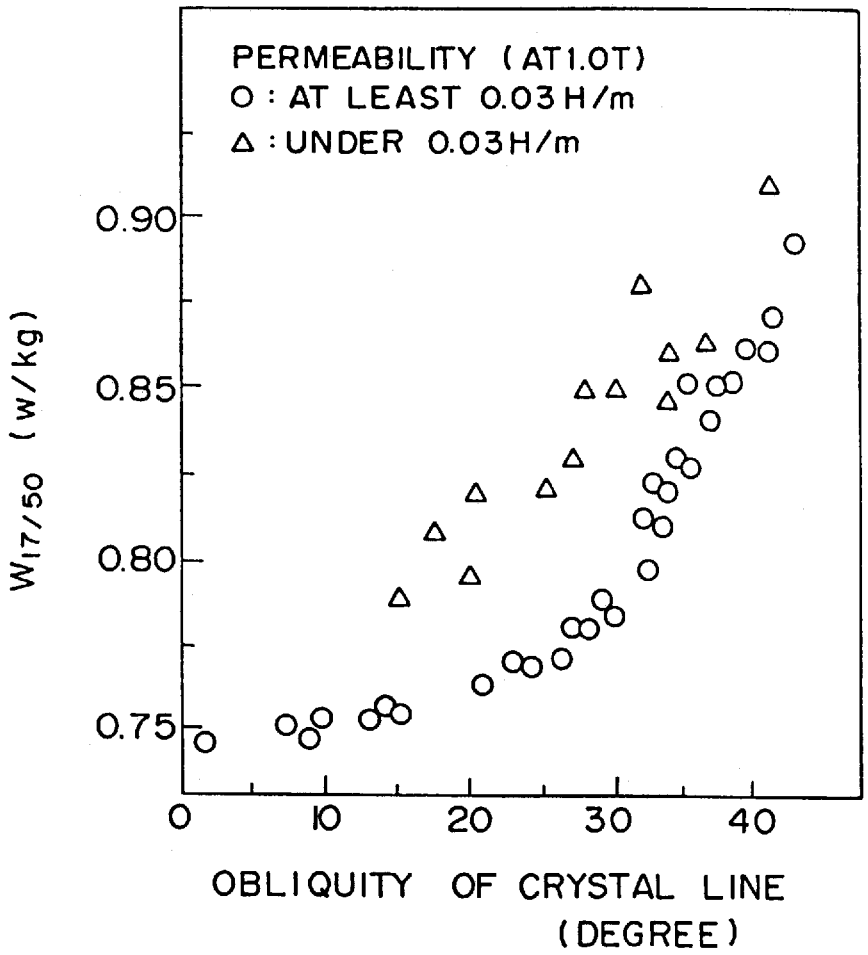
FIG. 6 is a graph illustrating the relationship between grain boundary line obliquity and iron loss.

With reference to this evaluation of obliquity, data showing an area ratio of fine crystal grains of up to 15% were arranged in order from among the iron loss data illustrated in FIG. 2. The result is shown in FIG. 6. From this result, it becomes established that a very low iron loss is available with an obliquity of up to about 30°, or more preferably, of up to about 25°.

Even with an obliquity angle of up to about 30°, however, some products may have a high iron loss (plots Δ in FIG. 6). These have been found to be products having a low magnetic permeability under about 1.0 T. The value of permeability under about 1.0 T represents the degree of a mobility of a magnetic wall at a magnetic flux density corresponding to the largest amount of displacement of the magnetic wall. With a large value of this permeability under about 1.0 T, flow of magnetic flux in the rolling direction is facilitated, leading to higher uniformity of flux density.

In order to improve permeability under about 1.0 T, it is necessary that impurities in steel such as C, S and N should be minimized, and at the same time, the interface between the base iron and a film should be smooth.

Finally, in addition to the foregoing requirements, a grain-oriented electrical steel sheet with a very low iron loss should essentially have a tension film formed thereon, such as the one disclosed in Japanese Unexamined Patent Publication No. 52-25296. This requires a tension of at least 0.4 $kgf/mm^2$ per side as in conventionally known. A tension of over 2.0 $kgf/mm^2$ is not desirable because it causes exfoliation of the film. It is needless to mention that the tensile effect of the film may be brought about by a forsterite film formed during final annealing.

As a technique for further reducing iron loss of the grain-oriented electrical steel sheet, the conventionally known magnetic domain dividing technique may additionally be applied. Such magnetic domain dividing techniques include that disclosed in Japanese Examined Patent Publication No. 3-69968 (forming grooves on the surface of steel sheet), and that disclosed in Japanese Unexamined Patent Publication No. 62-96617 (forming regions containing fine strain in the steel sheet). In the steel sheet of the present invention, application of any of these techniques provides an excellent effect.

Figure 7:
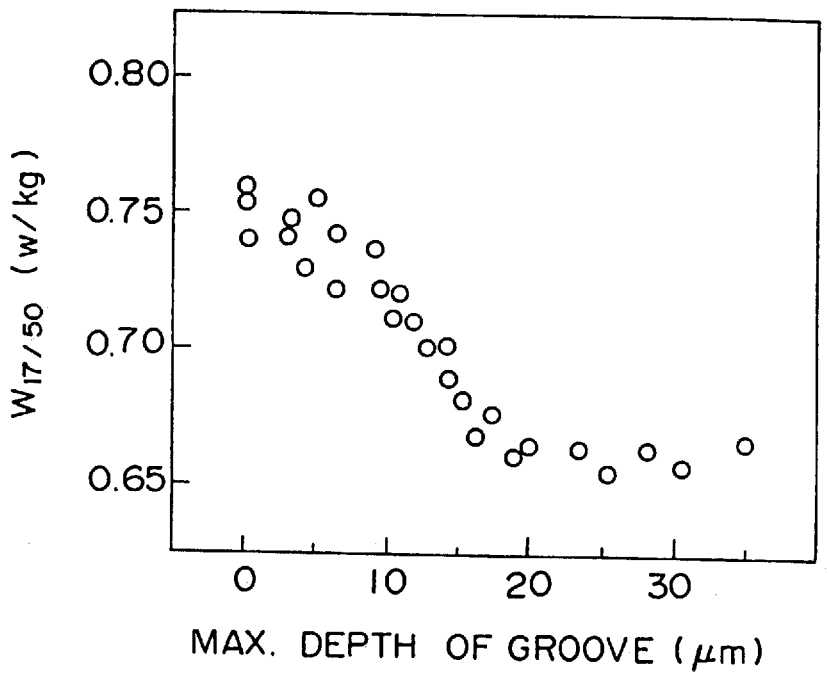
FIG. 7 is a graph illustrating the relationship between iron loss and the maximum depth of grooves when magnetic domain division is performed with the grooves.

FIG. 7 illustrates, in a case where grooves are provided by the etching method with various values of maximum depth in the rolling direction at intervals of 4 mm in a linear region in a direction at angles perpendicular to the rolling direction having a groove width of 150 μm on the steel sheet of the present invention (area ratio of fine crystal grains: about 3 to 7%, average grain diameter as an equivalent circle of coarse grains: about 15 to 25 mm, obliquity of grain boundary line: about 20° to 25°, permeability under about 1.0 T: at least about 0.0:3 H/m, and film tension on the surface of steel sheet: about 0.6 to 0.8 kgf/mm$^2$ per side), the relationship between the iron loss value and the maximum groove depth (the depth of the deepest point from the steel sheet surface when measuring the inside shape of grooves being herein defined as the maximum depth).

As shown in FIG. 7, a more excellent iron loss property is available by applying a magnetic domain dividing treatment to the grain-oriented electrical steel sheet of the present invention.

For this purpose, the grooves preferably have a maximum depth of at least about 12 $\mu$m and a width within a range of from about 50 to 500 $\mu$m, preferably formed in the rolling direction at intervals of from about 3 to 20 mm on the surface of the steel sheet. Regions of fine strain may preferably be provided in the rolling direction at a period of about 3 to 20 mm. For magnetic properties, the grooves should preferably have a depth of up to about 8 $\mu$m.

Now, the method of manufacturing the grain-oriented electrical steel sheet having a very low iron loss will be described.

First, it is possible to reduce the area ratio of fine crystal grains having a diameter of up to about 3 mm as a diameter of an equivalent circle to up to about 15% by achieving a slab chemical composition of the grain-oriented electrical steel sheet containing C and Al in steel and adjusting the contents thereof to a range of from about 0.01 to 0.10 wt. % and from about 0.005 to 0.050 wt. %, respectively.

Then, it is possible to control the average grain size as a diameter of an equivalent circle of coarse grains remaining after exclusion of fine grains within a range of from about 10 to 100 mm by applying a desiliconization treatment to form a desiliconization layer on the surface of the steel sheet in the annealing immediately before the final cold rolling, i.e., hot-rolled sheet annealing for a single stage of cold rolling, or intermediate annealing for two stages of cold rolling.

Furthermore, it is possible to achieve obliquity of the grain boundary line of coarse grains of up to about 30° by conducting at least two passes of warm rolling at a temperature of from about 150° to 300° C. during final cold rolling and controlling the oxide composition of the steel sheet surface after decarburizing annealing so that the peak ratio of fayalite (Af) to silica (As), Af/As, of infrared reflection spectra becomes at least about 0.8.

More specifically, formation of a desiliconization layer on the steel sheet surface before final cold rolling, and then conducting final cold rolling causes a change in rolling deformation behavior of the surface layer of the steel sheet, and a change in texture of primary recrystallized grains, and this is considered in turn to cause a change of the orientation dependency of the growing rate of secondary recrystallized grains. That is, this treatment leads to a sharp increase of growing rate of secondary recrystallized grains, not only in the rolling direction and at a direction at angles perpendicular to the rolling direction, but also in a direction at 45° to the rolling direction, resulting in a change of rhombohedral secondary recrystallized grains into square or rectangular secondary recrystallized grains. The obliquity of the grain boundary line thus decreases.

It is further possible to inhibit nitriding of the surface layer of the steel sheet during final annealing and to cause secondary recrystallization of crystal grains having excellent crystal orientation relative to adjacent grains, thus reducing the obliquity of the grain boundary line, by the presence of a desiliconization layer in the surface layer of the steel sheet, by achieving a ratio of Af/As of at least about 0.8 for the oxide composition of the steel sheet surface after decarburizing annealing, and adding metal oxides slowly releasing oxygen within a temperature range of from about 800° to 1,050° C., such as $CuO_2$, $SnO_2$, $MnO_2$, $Fe_3O_4$, $Fe_2O_3$, $Cr_2O_3$ and $TiO_2$ to the annealing separator to be applied before the final annealing.

In order to prevent deterioration of inhibitor force at the center of steel sheet at this point, it is necessary to achieve a heating rate of at least about 5° C./h from 870° C. to immediately before secondary recrystallization (at least to about 1,050° C.) during final finish annealing.

Then, a magnetic permeability of at least about 0.03 H/m under about 1.0 T of the product can be achieved by controlling the ratio Af/As of the oxide composition of the steel sheet surface after the above-mentioned decarburizing annealing to at least about 0.8, and adding metal oxides which release oxygen slowly within a temperature range of from about 800° to 1,050° C. to the annealing separator to be applied before final annealing.

This is attributable to the fact that, in addition to a change in the form of subscale of the decarburized/annealed sheet, the interface between the primer film formed during the final annealing and the base iron becomes smoother because of the presence of metal oxides, and further, impurities such as N, C, S and Se in steel are reduced in amount.

A primer film of oxides mainly comprising forsterite is formed on the steel sheet surface after final finish annealing. While this film has a tension-imparting effect, it is the common practice to apply and bake a phosphate film containing colloidal silica as a tensile film additionally on the primer film. Apart from this, a conventionally known tensile film of TiN, and a glass coating, are available. By forming this tensile film, a tension of from about 0.4 to 2.0 kgf/mm$^2$ (per side) is applied to the steel sheets surface, to reduce iron loss.

Iron loss can be further reduced by magnetic domain dividing. In the conventional art domain division is achieved by providing grooves. (Grooves are provided after final cold rolling and before decarburizing annealing, or even after final annealing. In the art of applying fine strain and then a domain dividing treatment, the method of the invention is applicable subsequent to final annealing.

Limiting numerical values for individual components of the electrical steel will now be described.

Si should be present in an amount within a range of from about 1.5 to 5.0 wt. %.

Si is effective for reducing iron loss, because it serves to increase the electric resistance of the steel sheet and to reduce eddy current loss. For this purpose, Si must be contained in an amount of at least about 1.5 wt. %. With a Si content of over about 5.0 wt. %, however, ductility for cold rolling is extremely deficient, thus increasing the manufacturing cost. The Si content should therefore be within a range of from about 1.5 to 5.0 wt. %. In addition, any element which forms a solid-solution through substitution may be present in the steel sheet. The content of such an element may appropriately be selected within a range not deviating from the scope of the present invention.

Then, regarding the crystal grains composing this steel sheet, fine grains having a diameter of up to about 3 mm as a diameter of an equivalent circle, and coarse grains of over about 3 mm should be controlled as follows, respectively.

The area ratio of fine crystal grains relative to the steel sheet should be up to about 15%. An area ratio over about 15% prevents smooth flow of magnetic flux in the rolling direction, and causes non-uniformity of distribution of flux density, and thus increases iron loss. When determining the area ratio, the surface film of the steel sheet is removed, and the steel sheet surface and the grain boundaries available from an etched macro-structure are employed.

Another requirement is that coarse grains other than the foregoing fine grains should have an average grain size within a range of from about 10 to 100 mm as a diameter of an equivalent circle. With an average grain size of coarse grains of under about 10 mm, flow of magnetic flux in the rolling direction is prevented for many grain boundaries, thus making it impossible to obtain a low iron loss value. In case of over about 100 mm, on the other hand, even a slight increase of obliquity of grain boundary causes a considerable change of flow of magnetic flux, resulting in deterioration of the iron loss value. In order to reduce the action of grain boundary preventing the flow of flux in the rolling direction as far as possible and reduce iron loss, therefore, the coarse grains should have an average size within a range of from about 10 to 100 mm.

The obliquity of the grain boundary line of the coarse crystal grains should be up to about 30°, or more preferably, up to about 25° with a view to avoiding prevention of the flow of flux along the grain boundary, achieving a uniform distribution of flux density, and thus reducing iron loss. When the obliquity of grain boundary line is over about 30°, the magnetic pole produced on the grain boundary exerts an adverse effect, the region in which magnetic flux density decreases covers a wider area, thus increasing non-uniformity of flux density, and iron loss considerably increases in spite of reduction of fine grains and coarsening of crystal grains.

The magnetic permeability under 1.0 T must be at least about 0.03 H/m. This makes the flow of flux smoother, and the low obliquity of grain boundary line brings about a favorable effect of reducing iron loss. In order to obtain a permeability under 1.0 T of at least about 0.03 H/m, the contents of impurities such as C, N and S should be low, and the interface between the film and the base iron should be smooth.

In addition, a tensile film should be present on the surface of the steel sheet. For this purpose, this film may be a multilayer film. For both a single-layer film and a multilayer film, the presence of a tension within a range of from about 0.4 to 2.0 kgf/mm$^2$ per side is necessary for reducing iron loss. With an imparted tension of under about 0.4 kgf/mm$^2$, there is only a limited iron loss reduction. With a tension of over about 2.0 kgf/mm$^2$, on the other hand, the tension effect exceeds the adhesion of the film, thus causing exfoliation of the film.

A novel electrical steel sheet having a very low iron loss is achievable by combining the foregoing requirements. Application of the magnetic domain dividing technique to the electrical steel sheet of the present invention enables a more excellent iron loss reducing effect. More specifically, because the iron loss reduction of the present invention is obtained by smoothening the flow of magnetic flux in the rolling direction and achieving a uniform distribution of flux density, application of domain division produces a remarkably increased effect.

For the purpose of reducing iron loss by domain division it is necessary to provide grooves on the steel sheet surface, or to provide regions of fine strain. For the former case, the grooves have a maximum depth of at least about 12 $\mu$m and form a linear region having a width of from about 50 to 500 $\mu$m. The grooves must be formed on the steel sheet surface at intervals of from about 3 to 20 mm in the rolling direction. A commercially effective iron loss reducing effect is unavailable under any other conditions. The term "linear region" as herein used means a region having a substantially constant width and extending in a given direction. It includes, for example, a plurality of circles connected in series in a given direction. The direction of this linear region should preferably be at about ±15° to a line extending perpendicular to the rolling direction.

In the latter case, regions of fine strain should be arranged at a period of from about 3 to 20 mm in the rolling direction. These regions may linearly arranged or arrayed in spots. Under conditions deviating from the above, a sufficient iron loss reducing effect is unavailable. The direction of these regions containing fine strain should preferably be in a direction at angles perpendicular to the rolling direction. Fine strain may be imparted by mechanically imparting strain from above the film with a ball-point-pen or a pulse type laser, or by imparting strain from inside the steel sheet in the form of thermal strain via rapid heating and rapid cooling using such means as a continuous laser or a plasma jet. While all these methods can give satisfactory effects, the latter is superior in avoiding damage to the film.

A few important reasons for numerically limiting the individual method requirements of the present invention will mow be described.

The grain-oriented electrical steel sheet according to the present invention is manufactured by casting a molten steel, which may be obtained by conventional steelmaking, by continuous casting process or ingot-making, converting into a slab, hot-rolling into a hot-rolled sheet, then annealing as required, applying a single stage or two more stages with intermediate annealing between the cold rolling steps to form the annealed sheet into a final thickness, then decarburizing-annealing the resultant sheet, applying an annealing separator, and then conducting final annealing comprising secondary recrystallization annealing and purification annealing.

Preferable chemical content of this grain-oriented electrical steel sheet are as follows.

C is effective for improving the structure of hot-rolled sheets and reducing the area ratio of fine crystal grains having a diameter of up to about 3 mm as a diameter of an equivalent circle, and for this purpose, should be present in an amount of at least 0.01 wt. %. A C content of over 0.10 wt. % makes it difficult to accomplish decarburization and largely affects γ-transformation, thus leading to unstable secondary recrystallization. The C content should therefore be within a range of from about 0.01 to 0.10 wt. %.

The Si content should be within a range of from 1.5 to 5.0 wt. %, as described above.

Mn should be present in an amount of at least about 0.04 wt. % for the purpose of improving hot rolling properties. It serves as an inhibitor component of MnS or MnSe. An Mn content of over about 2.0 wt. % has a serious effect on y-transformation and makes secondary recrystallization unstable. The Mn content should therefore be within a range of from about 0.04 to 2.0 wt. %.

Al is a required element as an inhibitor component of AlN, and the presence of Al permits coarsening of secondary recrystallized grains. For this purpose, Al should be present in an amount of at least about 0.005 wt. %. With an Al content of over about 0.05 wt. %, however, secondary recrystallization becomes incomplete. The Al content should therefore be within a range of from about 0.005 to 0.05 wt. %.

Apart from the foregoing components, one or more additives selected from the group consisting of S, Se, Te and B, known as inhibitor components, may be contained. To obtain stable secondary recrystallization grains, any element selected from Cu, Ni, Sn, Sb, As, Bi, Cr, Mo and P may be present. The content of these element should preferably be within a range of from about 0.01 to 0.25 wt. % for Cu, Ni, Sn and Cr, from about 0.005 to 0.10 wt. % for Sb, As, Mo and P, and from about 0.001 to 0.01 wt. % for Bi.

N is an element necessary as a component of AlN. A shortage of N content can be replenished by applying a nitriding treatment in the manufacturing process.

The grain-oriented electrical steel slab after adjustment of chemical composition as described above is hot-rolled into a hot-rolled sheet.

The hot-rolled sheet is subsequently annealed as required, and then cold-rolled through a single stage or multiple stages with intermediate annealing, to attain final sheet thickness. Forming a desiliconization layer during annealing immediately before final cold rolling is essential. This permits control of the diameters of coarse grains as a diameter of an equivalent circle within a range of from about 10 to 100 mm, and provides for achievement of an obliquity angle of up to about 30° of the grain boundary line of coarse grains, together with control of subsequent final rolling and decarburizing annealing processes.

The thickness of the desiliconization layer from the steel sheet surface should preferably be within a range of from about 2 to 25 μm. A thickness of under about 2 μm leads to increased obliquity of the grain boundary line of coarse grains, resulting in deterioration of iron loss. With a thickness of over about 25 μm, on the other hand, the diameter as an equivalent circle becomes less than about 10 mm, also resulting in deterioration of iron loss.

In order to form the desiliconization layer as described above, it suffices, as a weak desiliconization treatment, to increase the oxidation capability of the annealing atmosphere to an extent sufficient to oxidize Si in the steel, at least during a portion of the annealing heat cycle. For this control of atmosphere, such gases as $H_2$, $N_2$, Ar, $H_2O$, $O_2$, CO and $CO_2$ may be appropriately mixed and used.

From about two to ten passes of final cold rolling are preferably performed. Rolling the sheet into a final thickness through a single pass degrades the shape of the steel sheet, and rolling through more than about ten passes into the final thickness leads to a decreased reduction of each rolling pass, thus reducing the beneficial effect of warm rolling.

The effects of warm rolling include changing macroscopic deformation behavior, controlling nuclear generating positions of secondary recrystallized grains, and reducing the obliquity of coarse crystal grains from among secondary recrystallized grains. In order to obtain these effects, a temperature of at least about 150° C. is required for the warm rolling, and at least two or more passes of rolling are necessary. At a warm rolling temperature of over 300° C., however, dissolution of fine carbides is encountered in the steel, the rolling texture deteriorates, and there is increased obliquity of secondary recrystallized grains. The area ratio of fine crystal grains increases together with creation of decreased average grain size of course crystal grains, thus resulting in deterioration of iron loss.

The coil after final cold rolling is subjected to degreasing. When manufacturing a grain-oriented electrical steel sheet having a further lower iron loss by the domain dividing technique, grooves may be provided on the steel sheet surface after degreasing. The grooves should have a maximum depth of at least about 12 μm, and should be provided at intervals of from about 3 to 20 mm in the rolling direction. When these conditions are satisfied a maximum domain dividing effect tends to take place, with attendant additional iron loss reduction. The upper limit of groove depth should preferably be about 50 μm to ensure excellent magnetic properties, and the groove width should preferably be within a range of from about 50 to 500 μm. Formation of such grooves may be achieved by masking the steel sheet surface and etching it.

Decarburizing annealing is usually carried out in a mixed atmosphere of $H_2$, $H_2O$ and a neutral gas. Decarburization to a C content of up to about 0.0030% is accomplished, and a subscale is formed on the steel sheet surface. For the subscale thus formed, it is necessary to control the oxide composition of the steel sheet surface so that the ratio of absorbed peak intensity of fayalite (Af) to absorbed peak intensity of silica (As), representing the ratio of absorbance of infrared reflection spectra, is at least about 0.8. When the ratio Af/As is under about 0.8, nitriding of the steel sheet surface proceeds during final annealing and increases obliquity, thus causing deterioration of iron loss. In order to achieve such a ratio of at least about 0.8, it is advantageous to carry out annealing in an atmosphere of the lowest possible oxygen potential so long as this oxygen potential ($PH_2O/PH_2$) is within the fayalite generating region and does not impair decarburization.

An annealing separator is applied to the steel sheet surface before final annealing. It is necessary to add metal oxides which release oxygen at a temperature within a range of from about 800° to 1,050° C. in a total amount of from about 1.0 to 20% to the annealing separation agent. Addition of such metal oxides in an amount of at least about 1.0% inhibits nitriting in the final annealing before secondary recrystallization, and control the growth orientation of secondary recrystallized grains, thus reducing the obliquity of coarse grains and improving iron loss properties. It is important that oxygen is released at a temperature within a range of from about 800° to 1,050° C. At a temperature of under about 800° C., this does not have any appreciable effect on secondary recrystallization. At a temperature of over about 1,050° C., secondary recrystallization has already been started, preventing beneficial improvement.

Oxygen released from these oxides eventually promotes decomposition and oxidation of such inhibitors as AlN, MnS and MnSe in steel, and at the same time, increases the oxygen potential of the steel sheet surface to reduce steel sheet nitriding ability and cause a change in secondary recrystallization behavior. This function must be maintained continuously before secondary recrystallization, and for this purpose, oxygen release at a temperature within a range of from about 800° to 1,050° C. must be accomplished slowly. A rapid progress of oxidation of the steel sheet must be avoided since it leads to a no-uniform interface shape and causes deterioration of magnetic permeability under 1.0 T. For this purpose, the total amount of addition of these metal oxides must be up to about 20%.

Metal oxides suitable for this purpose include polyvalent oxides such as $CuO_2$, $SnO_2$, $MnO_2$, $Fe_3O_4$, $Fe_2O_3$, $Cr_2O_3$ and $TiO_2$. These oxides release oxygen slowly in the form of, for example:

$$MO_2 \rightarrow MO_{2-x} + XO$$

$$MO_{2-x} \rightarrow MO + (1-X)O$$

$$MO \rightarrow MO_{1-x} + XO$$

$$MO_{1-x} \rightarrow M + (1-X)O$$

and have the effect of increasing the oxygen potential of the steel sheet surface over a wide temperature range.

Single metal oxides or a combination of two or more kinds of metal oxides may be added.

In the final annealing, the heating rate from about 870° C. to before secondary recrystallization (to at least 1,050° C.)

should be a rate of at least about 5° C./hr. While addition of oxygen-releasing metal oxides to the annealing separator causes deterioration of inhibitors in the surface layer of the steel sheet, a lower heating rate exerts an effect also on inhibitors in the thickness center portion of the steel sheet, thus impairing the inhibiting force as a whole, tending to lead to defective secondary recrystallization. In order to avoid this inconvenience and to accomplish secondary recrystallization completely, the heating rate from about 870° C. to at least about 1,050° C. should be at a rate of at least about 5° C./hr. The upper limit thereof should preferably be about 20° C./hr. Decrease in the heating rate or holding a constant temperature at a temperature of under about 870° C. is favorable for development of good magnetic properties because this improves the selectivity of secondary recrystallization nuclei.

After final annealing, it is the usual practice to remove the non-reacted annealing separator and to apply and bake a tensile coating. At the same time, a flattening treatment is applied to the steel sheet. After removal of a primer film formed during final annealing, a TiN or glass coating may be formed on the steel sheet surface. At all events, application of a tension within a range of from about 0.4 to 2.0 kgf/mm$^2$ (per side) onto the steel sheet surface reduces iron loss.

With a tension applied by the film to the steel sheet of under about 0.4 kgf/mm$^2$, only a limited tension effect is available, leading to a smaller decrease of iron loss. A tension of over about 2.0 kgf/mm$^2$ is not desirable because the tension surpasses adhesion of the film, which results in exfoliation of the film.

The magnetic domain dividing treatment gives an additional iron loss reducing effect. This may be achieved by forming grooves on the steel sheet surface during the period from final cold rolling through decarburizing annealing, or by imparting grooves or fine strain on the steel sheet surface at any of the steps from final annealing to tensile coating.

When forming grooves, grooves must have a maximum depth of at least about 12 $\mu$m and must be provided at intervals of from about 3 to 20 mm in the rolling direction, usually by the use of a toothed roll. Apart from the toothed roll, pressing with a toothed die may be used. The groove width should preferably be within a range of from about 50 to 500 $\mu$m.

When imparting fine strain, it is necessary to provide regions containing fine strain at a period of from about 3 to 20 mm in the rolling direction. Applicable methods include mechanically imparting from above the film, or using thermal strain by rapid heating and cooling through application of a high temperature into the interior of the steel sheet, with the use of such as a continuous laser or plasma jet, for example.

EXAMPLES

(Example 1)

Eleven slabs (A to K) of steel comprising 0.072 wt. % C, 3.35 wt. % Si, 0.072 wt. % Mn, 0.008 wt. % P, 0.003 wt. % S, 0.026 wt. % Al, 0.018 wt. % Se, 0.026 wt. % Sb. 0.008 wt. % N and the balance iron and incidental impurities were heated to 1,420° C., and then hot-rolled to a thickness of 2.2 mm. Subsequently, the rolled sheets were subjected to hot-rolled sheet annealing at 1,000° C. for 30 seconds, and cold-rolled through a first cold rolling to an intermediate thickness of 1.5 mm.

Then, the sheets were subjected to intermediate annealing for weak desiliconization at 1,100° C. for 60 seconds in an atmosphere comprising 30% $H_2$ and 70% $N_2$ and having a dew point of 40° C. for A to J, and in a dry atmosphere comprising 30% $H_2$ and 70% $N_2$ for K as a comparative example. Then, rapid cooling was conducted by means of mist water to 350° C. at a rate of 40° C./second. After holding at a temperature of 350° C.±20° C. for 20 seconds, the sheets were passed through a pickling tank at 80° C. to remove scale adhering to the outer surface. Observation of the surface portion of the steel sheets revealed presence of a desiliconization layer of 10 to 15 $\mu$m formed in each of A to J, and absence of a desiliconization layer in K.

Subsequently, the coils A to K were rolled on a Sendzimir mill through six passes of rolling into a final thickness of 0.22 mm. For some passes, warm rolling was carried out within a temperature range of from 180° to 230° C. by reducing the flow rate of a coolant oil. More specifically, warm rolling was applied in five passes for the coils A to E and K; warm rolling was carried out in three passes for the coil F; warm rolling was conducted in two passes for the coil G; warm rolling in one pass for the coil H; and ordinary cold rolling only for the coil I. For the coil J, warm rolling was performed at a temperature within a range of from 370° to 390° C. in five passes. In this rolling stage, therefore, the coils H, I and J are comparative examples.

A degreasing treatment was applied to coils after final cold rolling. In an atmosphere comprising 70% $H_2$ and 30% $N_2$ the dew point was adjusted to 45° C. for the coils A to D and F to K, and to 25° C. for the coil E, and decarburizing annealing was conducted at 850° C. for three minutes. As a result, the C content was from 12 to 22 ppm for the coils A to D and F to K, and 26 ppm for the coil E. The value of Af/As of oxide composition of the steel sheet surface was from 1.58 to 27 for the coils A to D and F to K, and 0.32 for the coil E. Therefore, the coil E in the decarburizing annealing stage was a comparative example.

Then, MgO containing 3 wt. % $SnO_2$ and 7 wt. % $TiO_2$ was applied to the coils A to C and E to K as an annealing separator to be applied before final annealing. An annealing separator comprising MgO alone was applied to the coil D. In terms of the additive to the annealing separation agent, the coil D was a comparative example.

Then, the coils were subjected to final annealing by holding in $N_2$ at 850° C. for 15 hours, heating to 1,200° C. in an atmosphere of 25% $N_2$ and 75% $H_2$ at a rate of 15° C./hr, holding in $H_2$ at 1,200° C. for five hours, then cooling for the coils A, B and D to K. For the coil C, on the other hand, the steps comprised heating to 850° C. in $N_2$, subjecting to an atmosphere comprising 25% $N_2$ and 75% $H_2$, heating to 900° C. at a rate of 15° C./hr, then holding for 15 hours, heating again to 1,200° C. at a rate of 15° C./hr, then holding at 1,200° C. in $H_2$ for five hours, and then cooling.

After final finish annealing, non-reacted annealing separator was removed, and. for the coils A and C to K, a tension coating agent mainly comprising magnesium phosphate containing 50% colloidal silica was applied, and the coils were baked at 800° C. for a minute, which served also as a flattening annealing, into products. The coil B as a comparative example was subjected to a flattening annealing treatment at 800° C. for a minute, and then an insulating coating of magnesium phosphate was baked at 300° C. for a minute to complete the products.

Iron loss for the products A to K was measured. As a domain dividing treatment, plasma jet was irradiated linearly in a direction at angles perpendicular to the rolling direction, and in the rolling direction at intervals of 5 mm to measure iron loss.

For the products A to K, permeability under 1.0 T, film tension per side, area ratio of fine crystal grains after etching for macro-structure, average grain size of coarse grains, and obliquity of the grain boundary line of coarse grains were measured. The results are shown in Table 1.

TABLE 1-1

| COIL SYMBOL | INTERMEDIATE PROCESS ⊙: Weak desiliconization applied | FINAL ROLLING Hot rolling frequency at 150–350° C. | DECARBURIZATION -ANNEALING ⊙: Having Af/As of at least 0.8 | ANNEALING SEPARATOR ⊙: $SnO_2 + TiO_2$ added | FINAL ANNEALING ⊙: Without holding at 900° C. | FILM FORMING ⊙: Tension film | REMARKS |
|---|---|---|---|---|---|---|---|
| A | ⊙ | 5 | ⊙ | ⊙ | ⊙ | ⊙ | Example of this invention |
| B | ⊙ | 5 | ⊙ | ⊙ | ⊙ | — | Comparative example |
| C | ⊙ | 5 | ⊙ | ⊙ | — | ⊙ | Comparative example |
| D | ⊙ | 5 | ⊙ | — | ⊙ | ⊙ | Comparative example |
| E | ⊙ | 5 | — | ⊙ | ⊙ | ⊙ | Comparative example |
| F | ⊙ | 3 | ⊙ | ⊙ | ⊙ | ⊙ | Example of this invention |
| G | ⊙ | 2 | ⊙ | ⊙ | ⊙ | ⊙ | Example of this invention |
| H | ⊙ | 1 | ⊙ | ⊙ | ⊙ | ⊙ | Comparative example |
| I | ⊙ | 0 | ⊙ | ⊙ | ⊙ | ⊙ | Comparative example |
| J | ⊙ | 0 | ⊙ | ⊙ | ⊙ | ⊙ | Comparative example |
| K | — | 5 | ⊙ | ⊙ | ⊙ | ⊙ | Comparative example |

TABLE 1-2

| | PRODUCT PROPERTY | | | | | | | |
|---|---|---|---|---|---|---|---|---|
| COIL SYMBOL | MAGNETIC PERMIABILITY UNDER 1.0T (H/m) | FILM TENSION $kgf/mm^2$ | AREA RATIO OF FINE GRAINS (%) | AVERAGE GRAIN SIZE OF COARSE GRAINS (mm) | OBLIQUITY OF COARSE GRAINS (°) | IRON LOSS BEFORE PJ IRRADIATION $W_{17/50}$ (W/kg) | IRON LOSS AFTER PJ IRRADIATION $W_{17/50}$ (W/kg) | REMARKS |
| A | 0.043 | 0.72 | 5.4 | 16.4 | 20 | 0.753 | 0.653 | Example of this invention |
| B | 0.031 | 0.21 | 3.7 | 21.3 | 18 | 0.845 | 0.764 | Comparative example |
| C | 0.024 | 0.68 | 16.3 | 25.4 | 39 | 0.952 | 0.897 | Comparative example |
| D | 0.025 | 0.65 | 6.4 | 22.6 | 36 | 0.918 | 0.854 | Comparative example |
| E | 0.024 | 0.83 | 5.3 | 18.3 | 35 | 0.915 | 0.850 | Comparative example |
| F | 0.044 | 0.70 | 3.7 | 21.5 | 23 | 0.768 | 0.668 | Example of this invention |
| G | 0.053 | 0.54 | 5.2 | 22.4 | 27 | 0.820 | 0.725 | Example of this invention |
| H | 0.037 | 0.62 | 3.6 | 18.6 | 32 | 0.908 | 0.843 | Comparative example |
| I | 0.042 | 0.77 | 9.6 | 29.3 | 39 | 0.943 | 0.885 | Comparative example |
| J | 0.032 | 0.65 | 16.5 | 12.2 | 39 | 0.935 | 0.872 | Comparative example |
| K | 0.038 | 0.70 | 8.4 | 8.2 | 36 | 0.924 | 0.867 | Comparative example |

As shown in Table 1, in the products made from the coils A, F and G satisfying all the requirements for the grain-oriented electrical steel sheet of the present invention, permeability under 1.0 T, film tension, area ratio of fine grains among grains composing the steel sheet, average grain size of coarse grains, and obliquity of coarse grains had appropriate values and therefore excellent iron loss property was achieved. By the application of the domain dividing technique based on plasma jet (PJ) irradiation, a more excellent iron loss was achieved.

(Example 2)

Six slabs of a grain-oriented electrical steel comprising 0.068 wt. % C, 3.25 wt. % Si, 0.75 wt. % Mn, 0.012 wt. %

P, 0.015 wt. % S, 0.027 wt. % Al, 0.08 wt. % Sn, 0.018 wt. % Sb, 0.15 wt. % Cu, 0.012 wt. % Mo, 0.008 wt. % N, and the balance iron and incidental impurities were prepared. These slabs were hot-rolled to a thickness of 2.6 mm for three slabs (symbols L, M and N), to a thickness of 2.2 mm for two slabs (O and P), and to a thickness of 2.0 mm for a slab (Q).

The coils O, P and Q were subjected to hot-rolled sheet annealing at 1,000° C. for 30 seconds, pickled and cold-rolled to a thickness of 1.5 mm (O and P) and 1.4 mm (Q). The coils L, M and N were pickled, and then rolled to a thickness of 1.8 mm. Subsequently, the coils L, M. N, 0, P and Q were subjected to intermediate annealing at 1,100° C. for 60 seconds in an atmosphere comprising 60% $H_2$ and 40% $N_2$ with a dew point of 45° C., rapidly cooled to 330° C. with mist water at a cooling rate of 50° C./second, held at 330° C. for 20 seconds, cooled to 100° C., and passed through an HCl bath at 80° C. to remove scale on the outer surface. After annealing the surface desiliconization layers had a thickness of 18 μm for L, 16 μm for M, 17 μm for N, 14 μm for 0, 16 μm for P and 19 μm for Q.

Each coil was rolled on a Sendzimir mill through five passes. At this point, the flow rate of coolant oil was reduced and temperatures for the second to fourth passes were controlled within a range of from 180° to 240° C. for the coils L, N, O, P and Q, and within a range of from 350° to 370° C. for the coil M as a comparative example for warm rolling. Rolling temperature for the first and fifth passes was adjusted to below 150° C. in all cases. The final thickness was 0.26 mm for L, M, N and O, 0.22 mm for P and 0.19 mm for Q.

Subsequently, all the sheets were degreased, and a masking agent was selectively applied onto the steel sheet surfaces. By electrical-etching the portion not applied with the masking agent, grooves having a depth of 25 μm and a width of 150 μm and extending in a direction at 85° to the rolling direction were provided on the steel sheet surface at intervals of 4 mm in the rolling direction.

Then, decarburizing annealing was conducted in an atmosphere comprising 60% $H_2$ and 40% $N_2$ with a dew point of 45° C. at 850° C. for two minutes. Analysis of oxides on the thus decarburizing-annealed sheet surfaces by the infrared reflection method revealed only fayalite in all cases.

Thereafter, for the coils L, N, O, P and Q, an annealing separator comprising MgO containing 8% $TiO_2$, 2% $Fe_2O_3$ and 3% $Sr(OH)_2.8H_2O$ was applied, and for coil N, MgO containing 20% $TiO_2$, 5% $Fe_2O_3$ and 3% $Sr(OH)_2.8H_2O$ was applied in an amount of 10 g/m$^2$ on the steel sheet surface, and after coiling, final annealing was performed.

The final annealing was carried out, after holding in $N_2$ at 840° C. for 45 hours, by heating in 30% $N_2$ and 70% $H_2$ to 1,200° C. at a rate of 12° C./hr, then holding in $H_2$ at 1,200° C. for five hours, and then cooled. After this final finish annealing, the non-reacted annealing separator was removed, then a tension coating mainly comprising magnesium phosphate containing 50% colloidal silica was applied onto the coils which were then baked at 800° C. for a minute as a flattening annealing formation into products.

Iron loss property, permeability under 1.0 T, film tension per side, area ratio of fine grains after etching for macrostructure, average grain size of coarse grains and obliquity of grain boundary line of coarse grains for these products are shown in Table 2.

TABLE 2

| COIL SYMBOL | SHEET THICKNESS (mm) | PERMIABILITY UNDER 1.0T (H/m) | FILM TENSION kgf/mm$^2$ | AREA RATIO OF FINE GRAINS (%) | COARSE GRAINS AVERAGE GRAIN SIZE (mm) | COARSE GRAINS OBLIQUITY (°) | IRON LOSS $W_{17/50}$ (W/kg) | EXAMPLE |
|---|---|---|---|---|---|---|---|---|
| L | 0.26 | 0.037 | 0.53 | 2.3 | 28.3 | 20 | 0.708 | Example of this invention |
| M | 0.26 | 0.029 | 0.54 | 18 | 8.5 | 34 | 0.935 | Comparative Example |
| N | 0.26 | 0.025 | 0.58 | 4.4 | 25.5 | 28 | 0.887 | |
| O | 0.26 | 0.042 | 0.55 | 5.3 | 24.2 | 19 | 0.685 | Example of this invention |
| P | 0.22 | 0.045 | 0.68 | 4.8 | 15.8 | 18 | 0.632 | |
| Q | 0.19 | 0.038 | 0.74 | 3.5 | 19.3 | 22 | 0.604 | |

According to the present invention, a grain-oriented electrical steel sheet is created having a very low iron loss, an area ratio of fine grains, average grain size of coarse grains, obliquity of the grain boundary line of coarse grains, permeability under about 1.0 T, and film tension.

When manufacturing such a grain-oriented electrical steel sheet, the method of the present invention controlling such conditions as formation of a desiliconization film, warm rolling, oxide composition of the decarburization-annealed steel sheet surface, additives to the annealing separator, heating rate at a specific timing during final annealing, and physical properties of coating provides many industrially useful effects.

What is claimed is:

1. In a method of manufacturing a grain-oriented electrical steel sheet having a very low iron loss, wherein hot rolling is applied to an electrical steel slab to make a hot-rolled sheet, said slab comprising from about 0.01 to 0.10 wt % C, from about 1.5 to 5.0 wt % Si, from about 0.04 to 2.0 wt % Mn, and from about 0.005 to 0.050 wt % Al, and wherein a final sheet thickness is achieved through one or more stages of cold rolling, with intervening annealing in the case of plural stages of cold rolling, and then said cold-rolled steel sheet is subjected to decarburization annealing, the steps which comprise:

(a) annealing immediately before final cold rolling to form a desiliconization layer on said steel sheet;

(b) conducting from two to about ten passes of final cold or warm rolling, at least about two of which passes comprise warm rolling at a temperature within a range of from about 150° to 300° C.;

said decarburizing annealing being conducted such that, after decarburizing annealing, the surface of said steel sheet has an oxide composition having a peak ratio of fayalite (Af) to silica (As) in infrared reflection spectrum, Af/As, of at least about 0.8;

(c) adding to said steel an annealing separator before said final annealing, with metal oxides that are capable of slowly releasing oxygen at least at a temperature within a range of from about 800° to 1,050° C., said annealing separator including a plurality of metal oxides added in a total amount within a range of from about 1.0 to 20% of said annealing separator;

wherein said final annealing is carried out at a heating rate of at least about 5° C./hr. from about 870° C. to at least about 1,050° C.; and (d) forming a tension coating on said steel sheet after said final annealing.

2. The method defined in claim 1, wherein, in said stage after said completion of said final cold rolling and before said decarburizing annealing, grooves having a maximum depth of at least about 12 μm are formed along the rolling direction of said steel sheet at intervals within a range of from about 3 to 20 mm on the surface of said steel sheet.

3. The method defined in claim 1 wherein, after completion of said final annealing step, grooves having a maximum depth of at least about 12 μm are formed along the rolling direction of said steel sheet at intervals within a range of from about 3 to 20 mm on the surface of the steel sheet, at a period within a range of from about 3 to 20 mm are formed in the rolling direction.

4. The method defined in claim 1, wherein, after completion of said final annealing, regions containing fine strain in the surface layer of said steel sheet are formed along said rolling direction, at intervals within a range of from about 3 to 20 mm on the surface of said steel sheet.

* * * * *

UNITED STATES PATENT AND TRADEMARK OFFICE

CERTIFICATE OF CORRECTION

PATENT NO. : 5,853,499
DATED : December 29, 1998
INVENTOR(S) : Komatsubara, et al.

It is certified that error appears in the above-identified patent and that said Letters Patent is hereby corrected as shown below:

In Column 1, line 58, please change "this" to --the--.

In Column 2, line 47, please change "irk" to --in--;
line 56, please change "stage" to --stages--;
line 61, please change "; and" to --.--.

In Column 6, line 45, please delete "in".

In Column 8, line 35, please change "sheets" to --sheet--.

Signed and Sealed this

Twenty-fourth Day of August, 1999

*Attest:*

Q. TODD DICKINSON

*Attesting Officer*

*Acting Commissioner of Patents and Trademarks*